US005754083A

United States Patent [19]

Abe et al.

[11] Patent Number: 5,754,083

[45] Date of Patent: May 19, 1998

[54] TM MODE DIELECTRIC RESONATOR HAVING FREQUENCY ADJUSTING HOLES WITH VOIDS

[75] Inventors: Shin Abe, Mukoh; Toru Kurisu, Kyoto, both of Japan

[73] Assignee: Murata Manufacturing Co., Ltd., Japan

[21] Appl. No.: 901,252

[22] Filed: Jul. 28, 1997

Related U.S. Application Data

[63] Continuation of Ser. No. 755,122, Nov. 22, 1996, abandoned, which is a continuation of Ser. No. 464,395, Jun. 5, 1995, abandoned.

[30] Foreign Application Priority Data

Sep. 13, 1994 [JP] Japan ..... 6-218818

[51] Int. Cl.[6] ..... H01P 7/10

[52] U.S. Cl. ..... 333/219.1; 333/235

[58] Field of Search ..... 333/202, 202 DB, 333/202 DR, 208, 209, 219, 219.1, 235

[56] References Cited

U.S. PATENT DOCUMENTS

| | | | |
|---|---|---|---|
| 4,728,913 | 3/1988 | Ishikawa et al. | 333/235 |
| 5,049,842 | 9/1991 | Ishikawa et al. | 333/219.1 X |

FOREIGN PATENT DOCUMENTS

| | | | |
|---|---|---|---|
| 0316813 | 5/1989 | European Pat. Off. . | |
| 2534088 | 4/1984 | France . | |
| 0263802 | 10/1988 | Japan | 333/219.1 |
| 4296104 | 10/1992 | Japan . | |

OTHER PUBLICATIONS

Ishikawa et al.; "800Mhz High Power Duplexer Using TM Dual Mode Dielectric Resonators"; *IEEE, MTT-S Digest vol. III*; Jun. 1–5, 1992; Albuquerque, New Mexico; pp. 1617–1620.

European Search Report of European Patent Application No. EP-95-11 0284; Feb. 27, 1996.

Patent Abstracts of Japan, vol. 17 No. 115 (E-1330); Mar. 10, 1993; JP-A-04 296104 (Murata Manufacturing Co., Ltd.); Oct. 20, 1992.

Patent Abstracts of Japan, vol. 17 No. 570 (E-1448); Oct. 15, 1993; JP-A-05 167318; (Murata Manufacturing Co., Ltd.); Jul. 2, 1993.

European Search Report on the European Patent Application No. EP-95-11 0284; Nov., 1995.

Patent Abstracts of Japan, vol. 12 No. 158 (E-608); May 13, 1988; JP-A-62 271503 (Murata Manufacturing Co., Ltd.); Nov. 25, 1987.

*Primary Examiner*—Robert Pascal
*Assistant Examiner*—Barbara Summons
*Attorney, Agent, or Firm*—Ostrolenk, Faber, Gerb & Soffen, LLP

[57] ABSTRACT

It is desirable to broaden a frequency adjusting range of a resonator, or an adjusting range of a coupling coefficient between two resonators, even in a downsized TM mode dielectric resonator by enhancing a ratio of frequency change relative to an amount of movement of a frequency adjusting dielectric rod, a frequency adjusting hole is formed in a direction orthogonal to a direction of an electric field which exists in a dielectric pillar at resonance, and a void is extended from the frequency adjusting hole in a direction that is orthogonal both to the electric field and also to the frequency adjusting hole. Thus the frequency adjusting range or the adjusting range of the coupling coefficient can be broadened even in a downsized TM mode dielectric resonator, even when the dielectric rod has a limited range of movement, without substantially enlarging the frequency adjusting dielectric rod.

10 Claims, 14 Drawing Sheets

FIG. 14
PRIOR ART
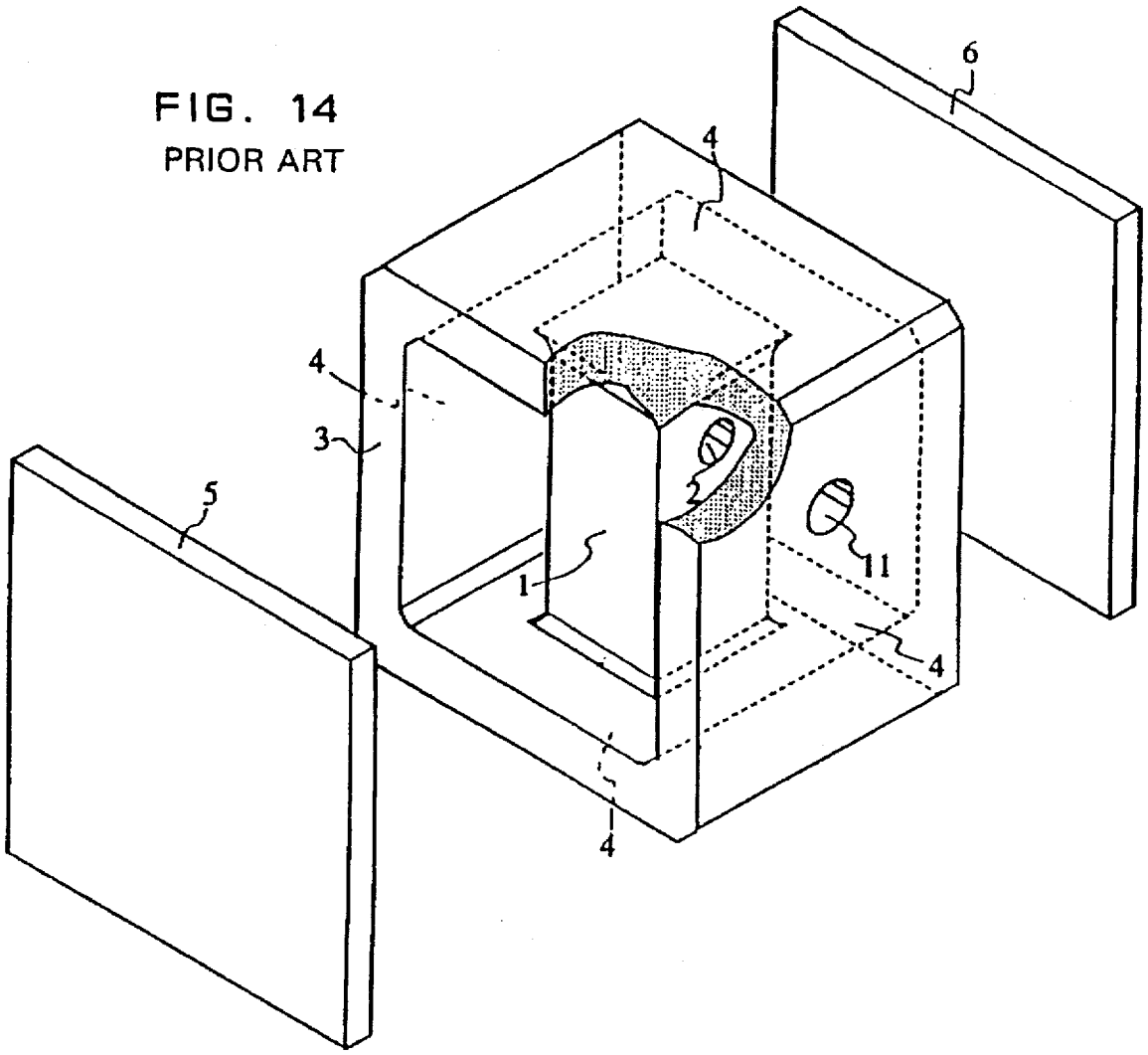
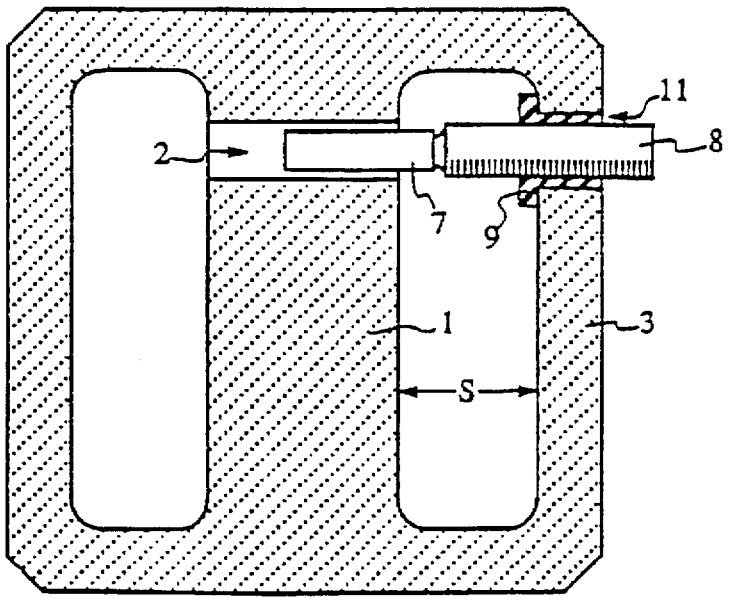
FIG. 15
PRIOR ART

TM MODE DIELECTRIC RESONATOR HAVING FREQUENCY ADJUSTING HOLES WITH VOIDS

This is a Continuation of application Ser. No. 08/755,122 filed on Nov. 22, 1996, now abandoned, which is a continuation of application Ser. No. 08/464,395 filed Jun. 5, 1995, now abandoned.

BACKGROUND OF THE INVENTION

1. Field of the Invention

The present invention relates to a TM (transverse magnetic) mode dielectric resonator in which a dielectric pillar is disposed in a space surrounded by a conductor.

2. Description of the Related Art

FIG. 14 and FIG. 15 show the structure of a conventional TM mode dielectric resonator. In FIG. 14, numeral 1 designates a prismatic dielectric pillar in which a frequency adjusting hole 2 is formed in a direction orthogonal to the axial direction of the dielectric pillar. Numeral 3 designates a cavity which is integrally formed with the dielectric pillar 1. A conductor 4 is formed on the top and bottom faces and on the left and right side faces of the cavity 3. A hole 11 is formed in the cavity 3 for guiding a frequency adjusting dielectric rod for movement into and out of the frequency adjusting hole 2 in the dielectric pillar 1. Two opening faces of the cavity 3 are covered with metallic panels 5 and 6.

FIG. 15 is a view showing a central vertical section of the TM mode dielectric resonator shown in FIG. 14, including a frequency adjusting dielectric rod. In FIG. 15, numeral 7 designates a frequency adjusting dielectric rod, numeral 8 designates a screw member for holding the frequency adjusting dielectric rod 7 and numeral 9 designates a holding member attached to the hole 11 formed in a side wall of the cavity 3. The screw member 8 is threaded to engage with the holding member 9.

FIGS. 16(A) and 16(B) show examples of electric fields created in the dielectric pillar of the TM mode dielectric resonator shown in FIG. 14 and FIG. 15. As shown in FIG. 16(A), in a region of the frequency adjusting hole 2 into which the dielectric rod is not inserted, electric lines of force pass almost totally through the dielectric portion of the dielectric pillar, detouring the frequency adjusting hole 2. By contrast, as shown in FIG. 16(B), in a region of the frequency adjusting hole 2 into which the dielectric rod 7 is inserted, the electric lines of force concentrate on the dielectric rod 7 in the frequency adjusting hole 2. In this way, an effective dielectric constant of the entire dielectric pillar is changed by inserting and withdrawing the frequency adjusting dielectric rod, whereby the resonance frequency is changed.

FIG. 17 and FIGS. 18(A) and 18(B) show an example of a TM mode dielectric resonator using a double mode, having a composite dielectric column having the shape of two intersecting dielectric pillars. As shown in FIG. 17, a composite dielectric pillar 1 has a shape of two intersecting dielectric pillars in which frequency adjusting holes denoted by 2*x* and 2*y* are installed. Holes 11*x* and 11*y* are provided in a side wall of the cavity 3 for holding frequency adjusting dielectric rods in the frequency adjusting holes 2*x* and 2*y*, respectively, so that they can be inserted and withdrawn. A hole 12 is also formed in a side wall of the cavity 3, for holding a coupling adjusting member which adjusts the coupling coefficient between two resonators formed by the two dielectric pillars constituting the composite dielectric pillar 1.

FIGS. 18(A) and 18(B) are a top view and a sectional view of the resonator shown in FIG. 17, respectively. In FIGS. 18(A) and 18(B), screw members 8*x* and 8*y* are threaded to engage with holding members 9*x* and 9*y*, respectively, and frequency adjusting dielectric rods 7*x* and 7*y*, respectively attached to end portions of the screw members 8*x* and 8*y*, are respectively inserted into and withdrawn from the dielectric pillars by turning them, thereby adjusting the frequency of the resonator comprising the dielectric pillars extending in the horizontal and the vertical directions. Further, in FIGS. 18(A) and 18(B), numeral 13 designates a dielectric rod for coupling adjustment between the two pillars that is threaded to engage with a holding member 14. The coupling coefficient between the two resonators comprising the two dielectric pillars is adjusted by inserting and withdrawing the coupling adjusting dielectric rod into and from one of four corner portions produced by the intersection of the two dielectric pillars.

However, as discussed further below, the available frequency adjusting range is narrowed by downsizing a TM mode dielectric resonator having a structure in which cylindrical frequency adjusting dielectric rods are inserted into and withdrawn from frequency adjusting holes having a circular sectional shape, as is illustrated in FIGS. 14, 15, 16(A), 16(B), 17, 18(A) and 18(B). Further, a coupling adjusting range is narrowed by downsizing a TM mode dielectric resonator having a structure in which a coupling adjustment is performed by inserting and withdrawing a coupling adjusting dielectric rod into and from a space inside a side wall of a cavity as is illustrated in FIGS. 17, 18(A) and 18(B).

That is, the dimensions of the dielectric pillars are determined in compliance with a frequency of use, and accordingly, in downsizing the overall TM mode dielectric resonator, the outer dimensions of the cavity are reduced as a result, whereby a ratio of the volume of the dielectric pillars to that of the cavity is increased and a distance between the dielectric pillar and the inner wall of the cavity denoted by S in FIG. 15, is shortened. As a result, the frequency adjusting dielectric rod 7 has an insufficient movable range (stroke). The stroke of the frequency adjusting dielectric rod must be further restricted to prevent interference with, for example, an input and output coupling loop, etc., due to the narrowing of the spaces between the metallic panels covering the opening portions of the cavity and the dielectric pillars, and between the inner walls of the cavity and the dielectric pillars. Finally, the range over which the frequency is variable is considerably restricted by downsizing the TM mode dielectric resonator. Further, with respect to a double mode resonator using a composite dielectric pillar, the adjustable range of the coupling coefficient is restricted since the coupling adjusting dielectric rod has an insufficient movable range.

To enlarge the frequency adjusting range given the limited movable range of the frequency adjusting dielectric rod, a ratio of frequency change relative to a moving distance of the frequency adjusting dielectric rod must be enhanced. It is effective for that purpose to enhance, for example, the dielectric constant of the frequency adjusting dielectric rod or to enlarge its sectional area. However, the dielectric constant is determined inherently by the materials that are usable for the frequency adjusting dielectric rod, and accordingly, the dielectric constant cannot considerably be enhanced. Further, spaces between the inner walls of the cavity or the metallic panels and the dielectric pillars are limited, and therefore, even if the frequency adjusting dielectric rod is enlarged, the structure of the holding member and the like for holding the rod also must be enlarged. Therefore, there is a limit on how much the frequency adjusting dielectric rod can be enlarged. The same limitations are also applicable to enlarging the coupling adjusting dielectric rod.

OBJECTS AND SUMMARY OF THE INVENTION

It is therefore an object of the present invention to provide a wide frequency adjusting range in a downsized TM mode dielectric resonator by enhancing a ratio of frequency change relative to moving distance of a frequency adjusting dielectric rod, without substantially enlarging the frequency adjusting dielectric rod.

It is another object of the present invention to provide a TM mode dielectric resonator providing a wide adjusting range of a coupling coefficient even in a downsized TM mode dielectric resonator by enhancing a ratio of coupling coefficient change relative to moving distance of a coupling adjusting dielectric rod.

According to a first aspect of the present invention, in view of the fact that the larger a difference between electric flux densities at portions in a frequency adjusting hole caused by the presence or absence of a frequency adjusting dielectric rod in the frequency adjusting hole, the larger a frequency change ratio of the frequency adjusting dielectric rod relative to a moving distance, it is desirable to increase the electric flux density of the frequency adjusting dielectric rod when it is inserted into the frequency adjusting hole. That is, in the first aspect of a TM mode dielectric resonator, a difference between the electric flux density at a portion in the frequency adjusting hole into which the frequency adjusting dielectric rod is not inserted, and the electric flux density at a portion thereof into which the frequency adjusting dielectric rod is inserted, is enhanced by providing the frequency adjusting hole with a void extending in a direction substantially orthogonal to a direction of an electric field that exists at resonance and also orthogonal to a direction in which the frequency adjusting hole extends.

According to a second aspect of the TM mode dielectric resonator, the void is extended in a direction away from the frequency adjusting hole with a width smaller than a width of the frequency adjusting dielectric rod.

According to a third aspect of the present invention, in a TM mode dielectric resonator of a double mode in which a composite dielectric pillar having a shape of two intersecting dielectric pillars is disposed in a space surrounded by a conductor, coupling adjusting holes are formed in a direction orthogonal to a plane made by the two dielectric pillars at an intersection of the two dielectric pillars to enhance a change ratio of coupling coefficients relative to a moving distance of coupling adjusting dielectric rods between two resonators comprising the two dielectric pillars, and a structure is provided for holding the coupling adjusting dielectric rods in the coupling adjusting holes in an insertable and withdrawable fashion.

According to a fourth aspect of a TM mode dielectric resonator, to enhance an amount of change of the coupling coefficient relative to the distance the coupling adjusting dielectric rods are moved into and out of the coupling adjusting holes, voids extending in a direction substantially orthogonal to a direction of an electric field passing through the coupling adjusting holes and also orthogonal to a direction in which the coupling adjusting holes extend, are provided to the coupling adjusting holes. The voids enhance a difference between a first electric density at a first portion in the coupling adjusting hole into which the coupling adjusting dielectric rod is not inserted and a second electric density of a second portion in the coupling adjusting hole into which the coupling adjusting dielectric rod is inserted.

Other objects, features and advantages of the invention will be appreciated from the following description of several embodiments thereof, with reference to the drawings.

BRIEF DESCRIPTION OF THE DRAWINGS

FIGS. 10(A) and 10(B) are sectional views cutting through a center axis of a dielectric pillar of a TM mode dielectric resonator in accordance with a second example wherein FIG. 10(A) shows a state before inserting a frequency adjusting dielectric rod and FIG. 10(B) shows a state wherein the frequency adjusting dielectric rod is inserted, respectively;

FIG. 14 is an exploded partially broken-away perspective view of a conventional TM mode dielectric resonator before assembling;

FIG. 15 is a central vertical sectional view of the TM mode dielectric resonator shown in FIG. 14, including a frequency adjusting dielectric rod;

DETAILED DESCRIPTION OF PREFERRED EMBODIMENTS

Figure 4A:
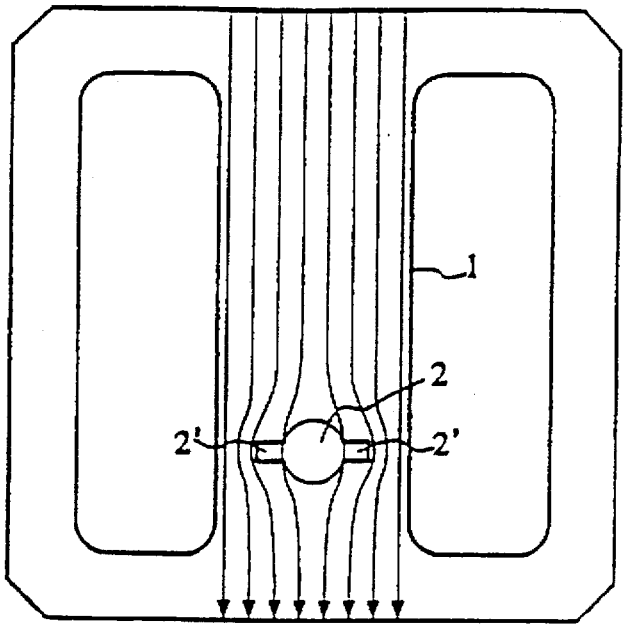
FIGS. 4(A) and 4(B) are views showing examples of a change of an electric flux density in a frequency adjusting hole of the TM mode dielectric resonator when a frequency adjusting dielectric rod is moved into and out of the frequency adjusting hole in accordance with the first example.
Figure 4B:
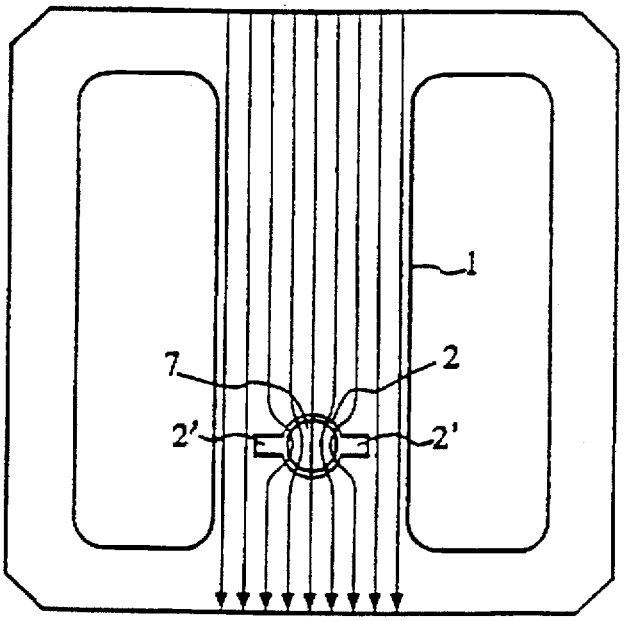

FIGS. 4(A) and 4(B) show examples of a change of an electric flux density in a frequency adjusting hole that can be brought about by inserting and withdrawing a frequency adjusting dielectric rod of a TM mode dielectric resonator into and out of the frequency adjusting hole in accordance with the first and second aspects of the present invention. FIG. 4(B) schematically shows a behavior of electric lines of force at a sectional portion of the resonator wherein a frequency adjusting dielectric rod 7 is inserted into a frequency adjusting hole 2. FIG. 4(A) schematically shows a behavior of electric lines of force at a sectional portion of the resonator wherein the frequency adjusting dielectric rod 7 is not inserted into the frequency adjusting hole 2.

As shown in FIG. 4(A), the electric lines of force pass around a portion in the frequency adjusting hole into which the frequency adjusting dielectric rod is not inserted, detouring the frequency adjusting hole 2 and a void 2'. The void 2' extends in a direction orthogonal to the frequency adjusting hole, and the frequency adjusting hole extends in a direction orthogonal to a direction of an electric field. By contrast, as shown in FIG. 4(B), the electric lines of force which have detoured the frequency adjusting hole 2 and the void 2' in FIG. 4(A), now cross the frequency adjusting dielectric rod 7 at a portion in the frequency adjusting hole 2 into which the frequency adjusting dielectric rod 7 is inserted. As a result, the dielectric flux density in the frequency adjusting hole changes considerably, depending on the presence or absence of the frequency adjusting dielectric rod. Thus a ratio of frequency change relative to an amount of movement of the frequency adjusting dielectric rod is enhanced.

Figure 12:
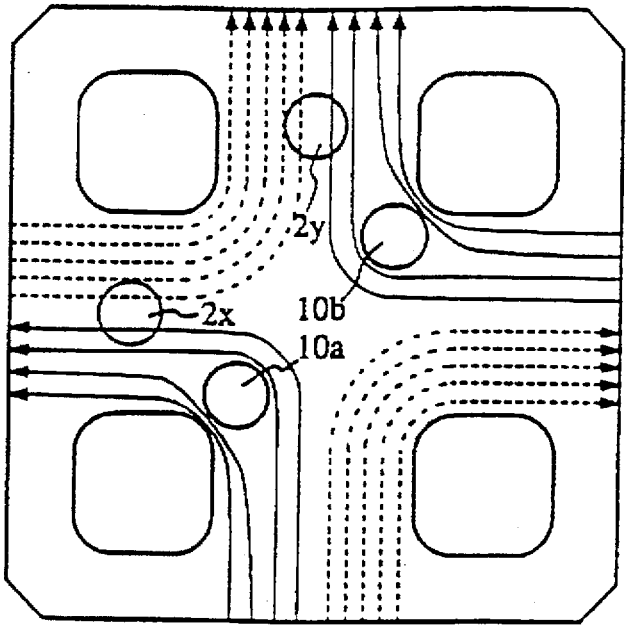
FIGS. 12(A) and 12(B) are views showing an example of a change of an electric flux density in coupling adjusting holes when coupling adjusting dielectric rods are moved into and out of the coupling adjusting holes in the TM mode dielectric resonator shown in FIG. 11.
Figure 12:
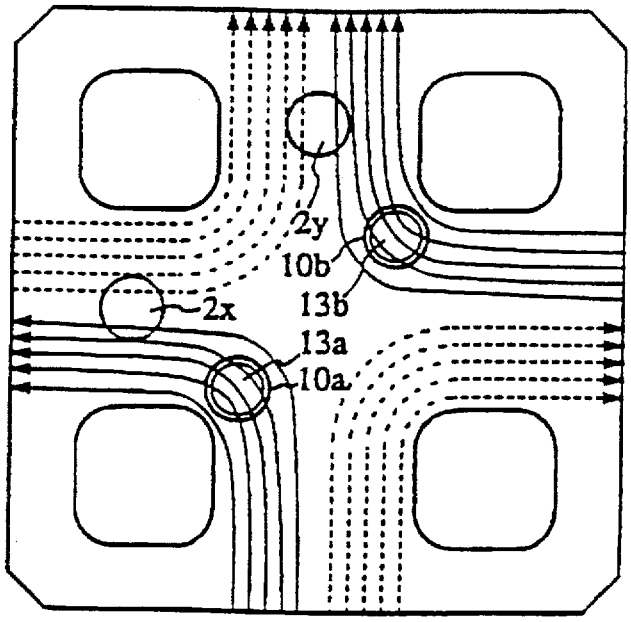

FIGS. 12(A) and 12(B) show an example of a change of an electric flux density in coupling adjusting holes when coupling adjusting dielectric rods are inserted and withdrawn in a TM mode dielectric resonator in accordance with the third aspect of the present invention. In FIGS. 12(A) and 12(B), notations 10*a* and 10*b* designate coupling adjusting holes. FIG. 12(B) schematically shows a behavior of electric lines of force in even mode and in odd mode at a sectional portion of the resonator in which coupling adjusting dielectric rods 13*a* and 13*b* are inserted into the coupling adjusting holes 10*a* and 10*b*. FIG. 12(A) schematically shows a behavior of electric lines of force in even mode and in odd mode at a sectional portion of the resonator in which the coupling adjusting dielectric rods 13*a* and 13*b* are not inserted into the coupling adjusting holes 10*a* and 10*b*. As explained hereinafter, arrow marks of solid lines indicate electric lines of force in even mode and arrow marks of broken lines indicate those in odd mode. As shown in FIG. 12(A), the electric lines of force in even mode detour the coupling adjusting holes 10*a* and 10*b* at a portion of the resonator in which the coupling adjusting dielectric rods are not present, whereas, as shown in FIG. 12(B), the electric lines of force in even mode pass through the coupling adjusting dielectric rods at a portion of the resonator in which the coupling adjusting dielectric rods 13*a* and 13*b* are present. The electric lines of force in odd mode stay constant irrespective of the presence or absence of the coupling adjusting dielectric rods. In this way, a difference between an effective dielectric constant in the even mode and that in the odd mode is considerably changed by inserting and withdrawing the coupling adjusting dielectric rods into and out of the coupling adjusting holes, whereby a wide range of coupling adjustment is made possible by a small amount of movement of the coupling adjusting dielectric rods.

Figure 13:
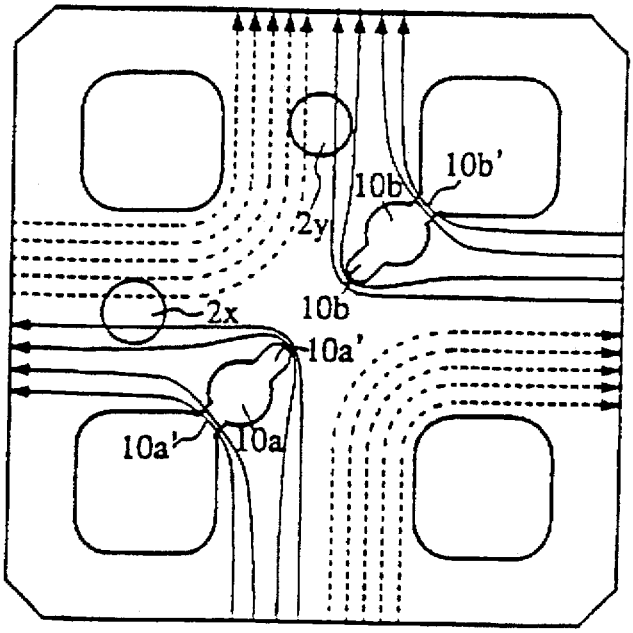
FIGS. 13(A) and 13(B) are views showing an example of a change of an electric flux density in coupling adjusting holes when coupling adjusting dielectric rods are moved into and out of the coupling adjusting holes in a TM mode dielectric resonator in accordance with a fourth example.
Figure 13B:
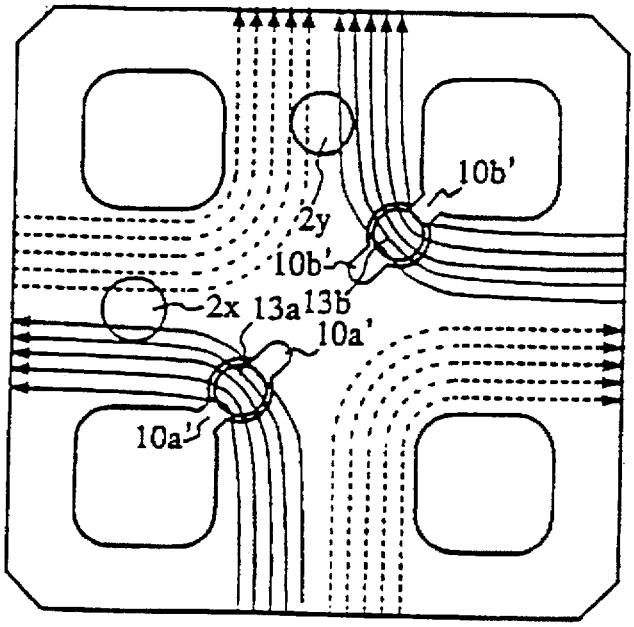
Figure 16A:
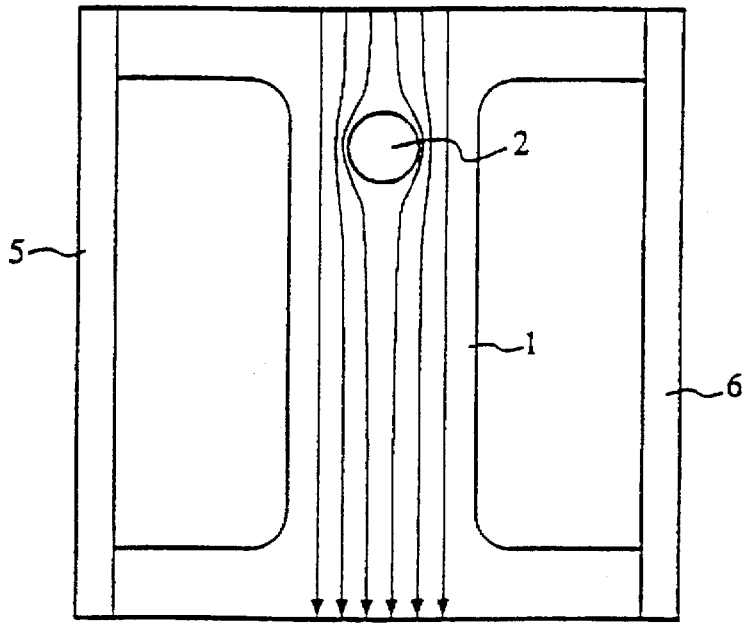
FIG. 16(A) PRIOR ART
FIGS. 16(A) and 16(B) are views showing examples of electric fields generated in a dielectric pillar of the TM mode dielectric resonator shown in FIG. 14 and FIG. 15.
Figure 16B:
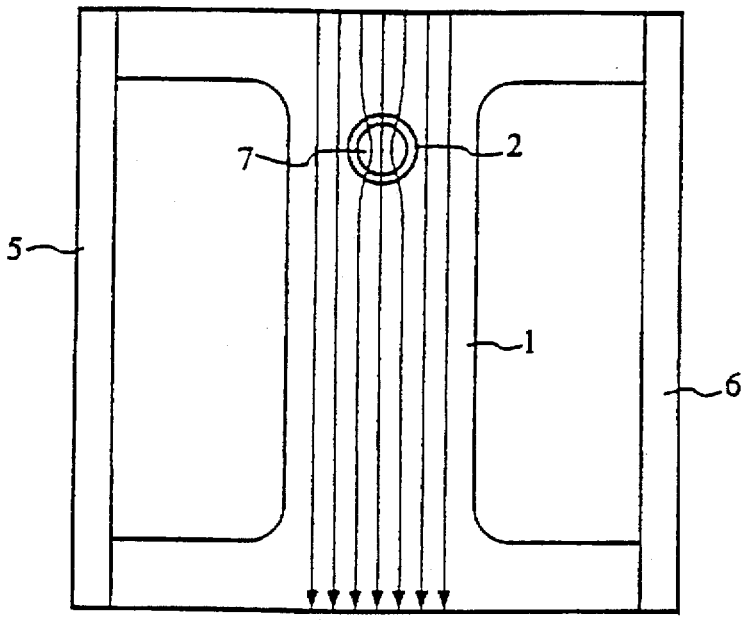
FIG. 16(B) PRIOR ART
Figure 17:
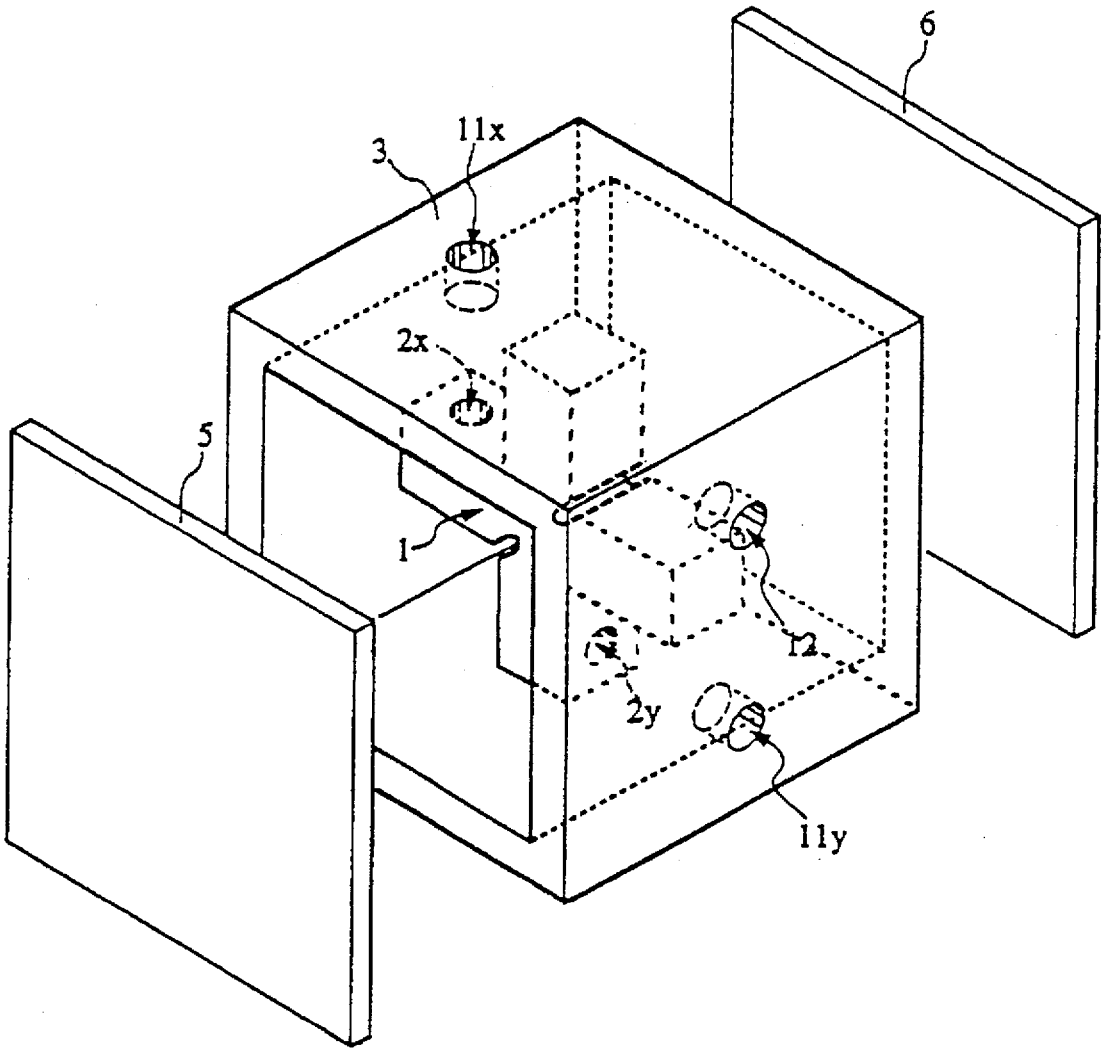
FIG. 17 PRIOR ART
FIG. 17 is a view showing another example of a conventional TM mode dielectric resonator utilizing a double mode and having a composite dielectric pillar.
Figure 18A:
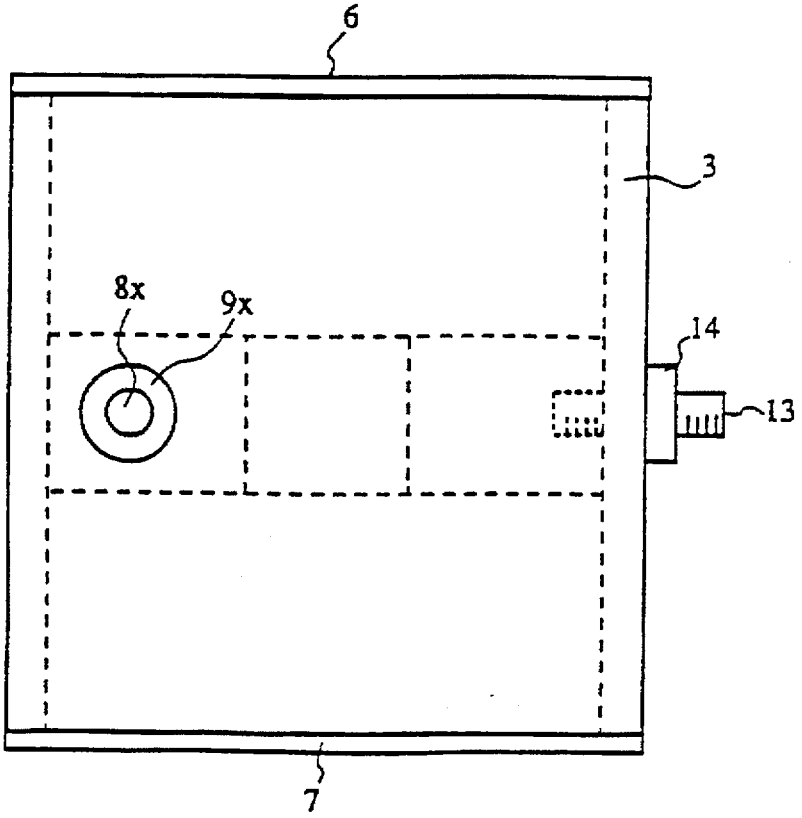
FIG. 18(A) PRIOR ART
FIGS. 18(A) and 18(B) are a top view and a sectional view of the resonator shown in FIG. 17, respectively.
Figure 18B:
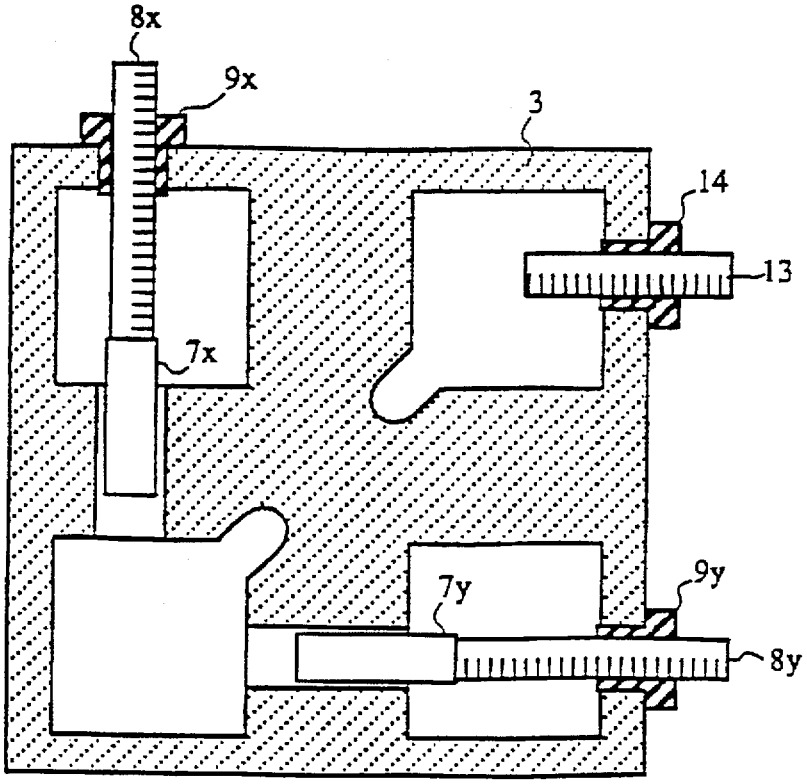
FIG. 18(B) PRIOR ART

FIGS. 13(A) and 13(B) show an example of a change of an electric flux density in coupling adjusting holes when coupling adjusting dielectric rods are inserted and withdrawn in a TM mode dielectric resonator into and from the coupling adjusting holes in accordance with the fourth aspect of the present invention. In FIGS. 13(A) and 13(B), notations 10*a* and 10*b* designate coupling adjusting holes, and voids 10*a'* and 10*b'* extending in a direction orthogonal to an electric field passing through the coupling adjusting holes 10*a* and 10*b* and also orthogonal to the coupling adjusting holes, extend from the coupling adjusting holes 10*a* and 10*b*. FIG. 13(B) schematically shows a behavior of electric lines of force in even mode and in odd mode at a sectional portion of the resonator in which the coupling adjusting dielectric rods 13*a* and 13*b* are inserted into the coupling adjusting holes 10*a* and 10*b*. FIG. 13(A) schematically shows a behavior of electric lines of force in even mode and in odd mode at a sectional portion of the resonator in which the coupling adjusting dielectric rods 13*a* and 13*b* are not inserted into the coupling adjusting holes 10*a* and 10*b*. As shown in FIG. 13(A), the electric lines of force in even mode detour the coupling adjusting holes 10*a* and 10*b* and the voids 10*a'* and 10*b'* at the portion in which the coupling adjusting dielectric rods are not present, whereas as shown in FIG. 13(B), the electric lines of force in even mode pass through the coupling adjusting dielectric rods at the portion in which the coupling adjusting dielectric rods 13*a* and 13*b* are present. In this way, in comparison with the case shown in FIGS. 12(A) and 12(B), there is a greater difference between a first electric flux density in the coupling adjusting holes at the portion in which the coupling adjusting dielectric rods 13*a* and 13*b* are not present and a second electric flux density in the coupling adjusting holes at the portion in which the coupling adjusting dielectric rods 13*a* and 13*b* are present, due to the voids 10*a'* and 10*b'* orthogonal to the direction of the electric field passing through the coupling adjusting holes 10*a* and 10*b* and extending orthogonal to a direction in which the coupling adjusting holes extend. Thereby, the change ratio of the coupling coefficient relative to the amount of inserting and withdrawing the coupling adjusting dielectric rod is further enlarged.

EXAMPLES

Figure 5:
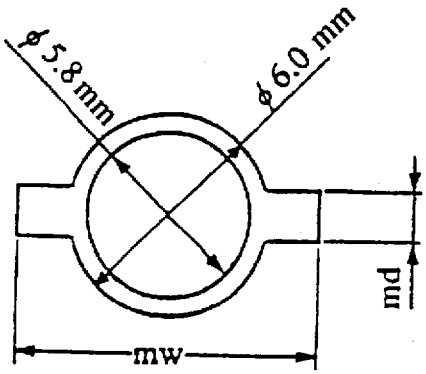
FIG. 5 is a view showing an example of dimensions of a frequency adjusting hole and a void.
Figure 6:
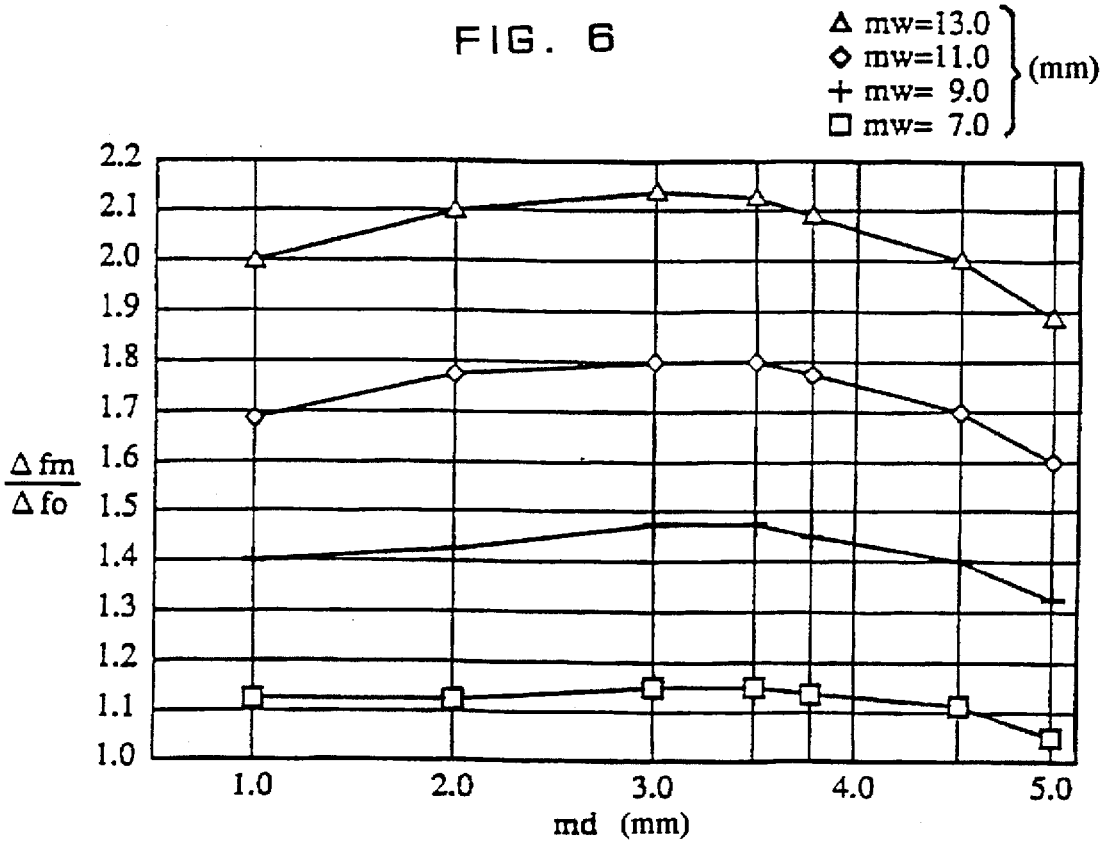
FIG. 6 is a graph showing changes in a frequency change ratio when md and mw specified in FIG. 5 are changed.

FIG. 1 through FIG. 5 show the structure of a TM mode dielectric resonator in accordance with a first embodiment of the present invention and FIG. 6 shows its frequency characteristics.

Figure 1:
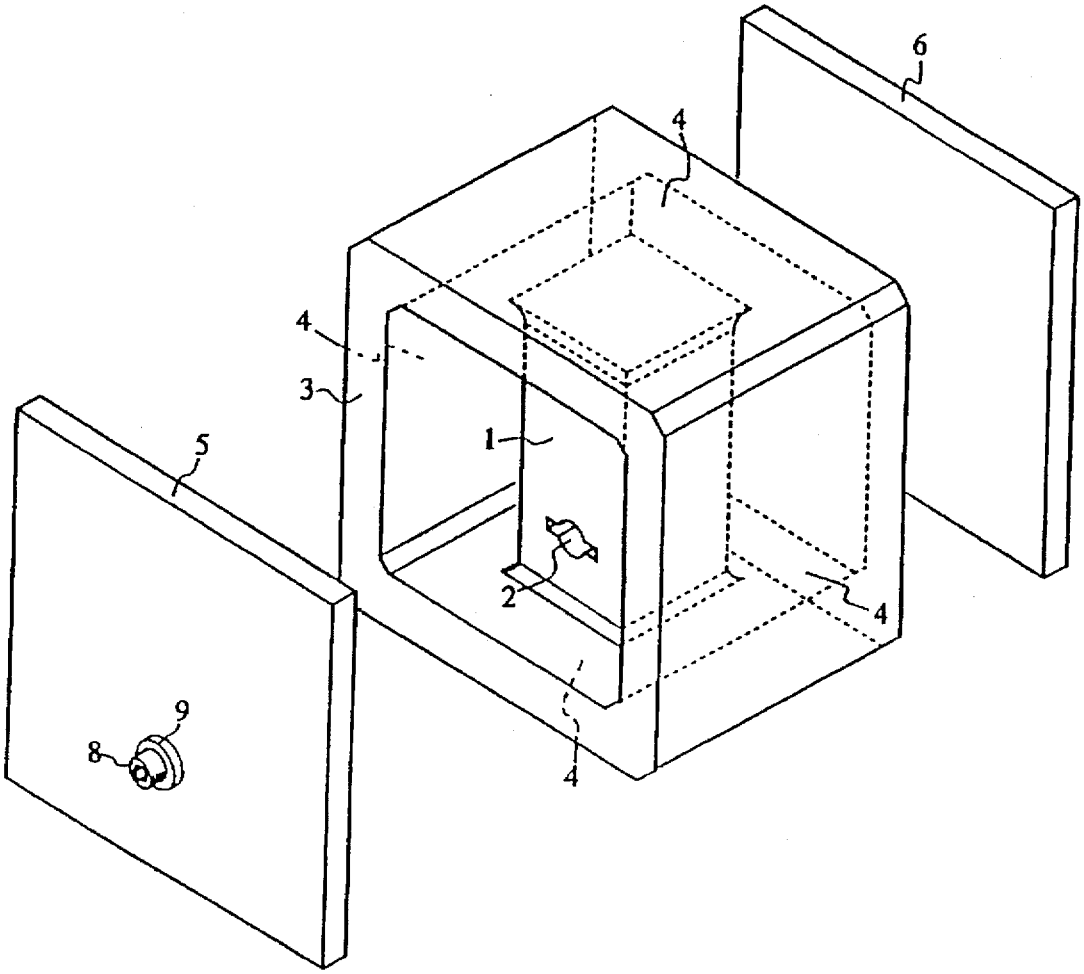
FIG. 1 is an exploded perspective view showing the structure of a TM mode dielectric resonator in accordance with a first example.

FIG. 1 is a perspective view showing the structure of a TM mode dielectric resonator before assembly. In FIG. 1, numeral 1 designates a prismatic dielectric pillar in which a frequency adjusting hole 2 is formed in a direction orthogonal to the axial direction of the dielectric pillar. Numeral 3 designates a cavity which is integrally formed with the dielectric pillar 1. A conductor 4 is formed on the top and bottom faces and the left and right side faces of the cavity 3. Two opening faces of the cavity 3 are covered with metallic panels 5 and 6. A frequency adjusting dielectric rod is held in the metallic panel 5 for movement into and out of the frequency adjusting hole 2 in the dielectric pillar 1.

Figure 2:
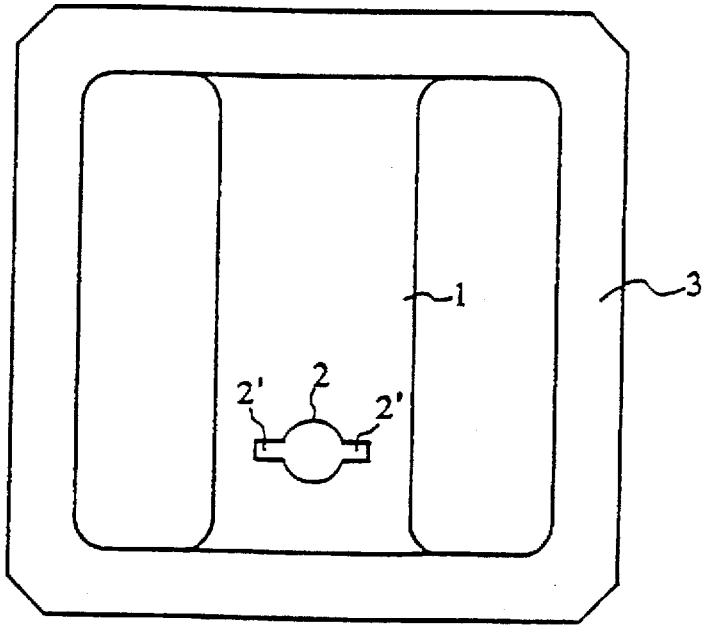
FIG. 2 is a front view viewing from one opening face of a cavity constituting the dielectric resonator shown in FIG. 1.
Figure 3:
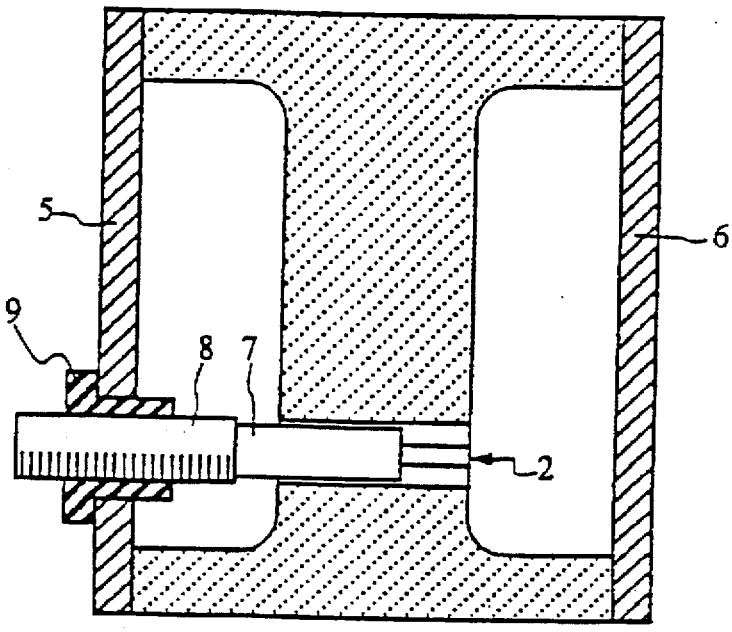
FIG. 3 is a vertical sectional view cut through a frequency adjusting hole in an assembled state of the TM mode dielectric resonator shown in FIG. 1.

FIG. 2 is a front view viewing from one opening face of the cavity 3 integrally formed with the dielectric pillar 1 shown in FIG. 1, and FIG. 3 shows a vertical sectional view cut through the frequency adjusting hole in an assembled state of the TM mode dielectric resonator shown in FIG. 1.

In FIG. 3, numeral 7 designates a frequency adjusting dielectric rod and numeral 8 designates a screw member integrated to the frequency adjusting dielectric rod 7. A holding member 9 is installed in the metallic panel 5 and the screw member 8 is threaded to engage with the holding member 9. That is, the frequency adjusting dielectric rod 7 is inserted into or withdrawn from the frequency adjusting hole 2 by turning the screw member 8 in the right direction or in the left direction.

FIGS. 4(A) and 4(B) show examples of a change in an electric flux density that is obtained in the frequency adjusting hole by inserting and withdrawing the frequency adjusting dielectric rod of the TM mode dielectric resonator into and from the frequency adjusting dielectric hole. As mentioned above in reference to FIGS. 4(A) and 4(B), FIG. 4(B) schematically shows a behavior of electric lines of force at a sectional portion of the resonator in which the frequency adjusting dielectric rod 7 is inserted into the frequency adjusting hole 2, whereas FIG. 4(A) schematically shows a behavior of electric lines of force at a sectional portion of the resonator in which the frequency adjusting dielectric rod 7 is not inserted into the frequency adjusting hole 2. As shown in FIG. 4(A), the electric lines of force detour the frequency adjusting hole 2 and a void 2' at a portion in the frequency adjusting hole into which the frequency adjusting dielectric rod is not inserted, whereas as shown in FIG. 4(B), the electric lines of force which have detoured the frequency adjusting hole 2 and the void 2' in FIG. 4(A), now cross the frequency adjusting dielectric rod 7 at a portion in the frequency adjusting hole 2 into which the frequency adjusting dielectric rod 7 is inserted. The void 2' extends from the frequency adjusting hole in a direction orthogonal to the frequency adjusting hole and extends in a direction orthogonal to a direction of an electric field. As a result, the electric flux density in the frequency adjusting hole is considerably changed depending on the presence or absence of the frequency adjusting dielectric rod, whereby a ratio of frequency change relative to an amount of movement of the frequency adjusting dielectric rod is enhanced.

Next, a specific example will be shown illustrating the effect on the improvement of a frequency change ratio by providing a void when the dimensions of the void are changed. Firstly, as shown in FIG. 5, a pair of voids have a width of md, and mw is the overall length of the frequency adjusting hole plus both voids. The frequency adjusting hole has an inner diameter of 6.0 mm and with it a frequency adjusting dielectric rod having the diameter of 5.8 mm is used. The specific dielectric constant of a dielectric pillar is 37.5 and that of the frequency adjusting dielectric rod is 90.0. FIG. 6 shows a simulation result showing the effect on the degree of improvement of a frequency change ratio when md and mw are changed. Δfo designates a frequency change ratio when the frequency adjusting hole is not provided with a void and is simply a circular hole, Δfm designates a frequency change ratio when a frequency adjusting hole having a void shown in FIG. 5 is used, and Δfm/Δfo designates a magnification of the frequency change ratio. Therefore, the larger the value of Δfm/Δfo, the larger the improvement of the frequency change ratio by providing the void. Δfo and Δfm are defined by the following equations:

$$\Delta fo=(fo'-fo)/fo,$$

$$\Delta fm=(fm'-fm)/fm$$

where fo and fm designate resonance frequencies when the frequency adjusting dielectric rod is not inserted and fo' and fm' designate resonance frequencies when the frequency adjusting dielectric rod is inserted.

As shown in FIG. 6, the magnification Δfm/Δfo of the frequency change ratio is increased by an increase in mw when md stays constant, and an increase in the magnification is observed with respect to md when md=1.0–5.0 mm.

Figure 7:
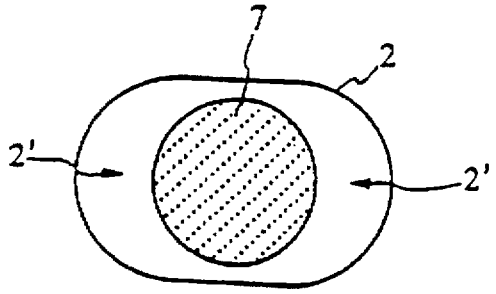
FIGS. 7(A), 7(B), 7(C) and 7(D) are views showing other examples of frequency adjusting holes.
Figure 7:
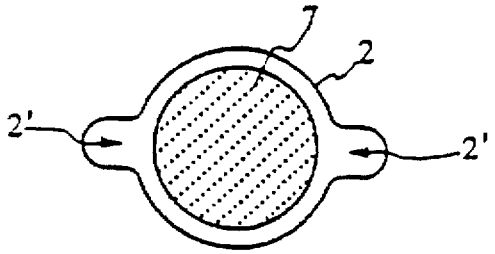
Figure 7:
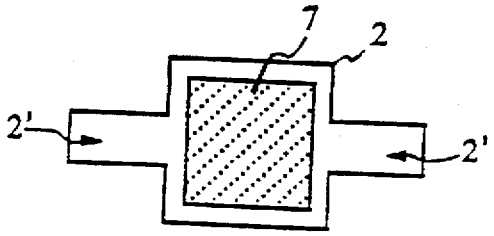
Figure 7:
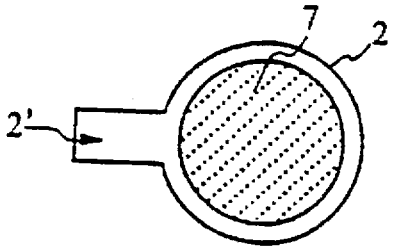

FIGS. 7(A), 7(B), 7(C) and 7(D) show examples of other shapes of frequency adjusting holes and frequency adjusting dielectric rods. In the example of FIG. 7(A), the frequency adjusting hole 2 is elliptical and voids 2' extend from both sides where the frequency adjusting dielectric rod 7 is inserted. In the example of FIG. 7(B), rounded portions are provided at roots and edges of the void 2', which prevents cracks from occurring when the dielectric pillar is formed, by dispersing stress concentrations that are applied at various portions of the frequency adjusting hole.

Although a frequency adjusting dielectric rod having a circular section is used in the above examples, a frequency adjusting dielectric rod having a polygonal section may be used and a frequency adjusting hole may have a shape in compliance therewith, for example, as shown in FIG. 7(C).

Further, although in the above examples, voids extend from both sides of the position in the frequency adjusting hole where the frequency adjusting dielectric rod is inserted, the void may extend only on one side thereof, for example, as shown in FIG. 7(D).

Following is a simulation result of the magnification of the frequency change ratio when the dimensions of the frequency adjusting hole are changed using the frequency adjusting hole and the frequency adjusting dielectric rod shown in FIG. 7(A).

Figure 8:
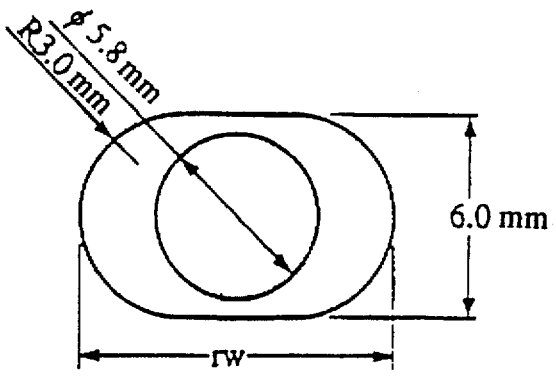
FIG. 8 is a view showing an example of dimensions of a frequency adjusting hole and a void.
Figure 9:
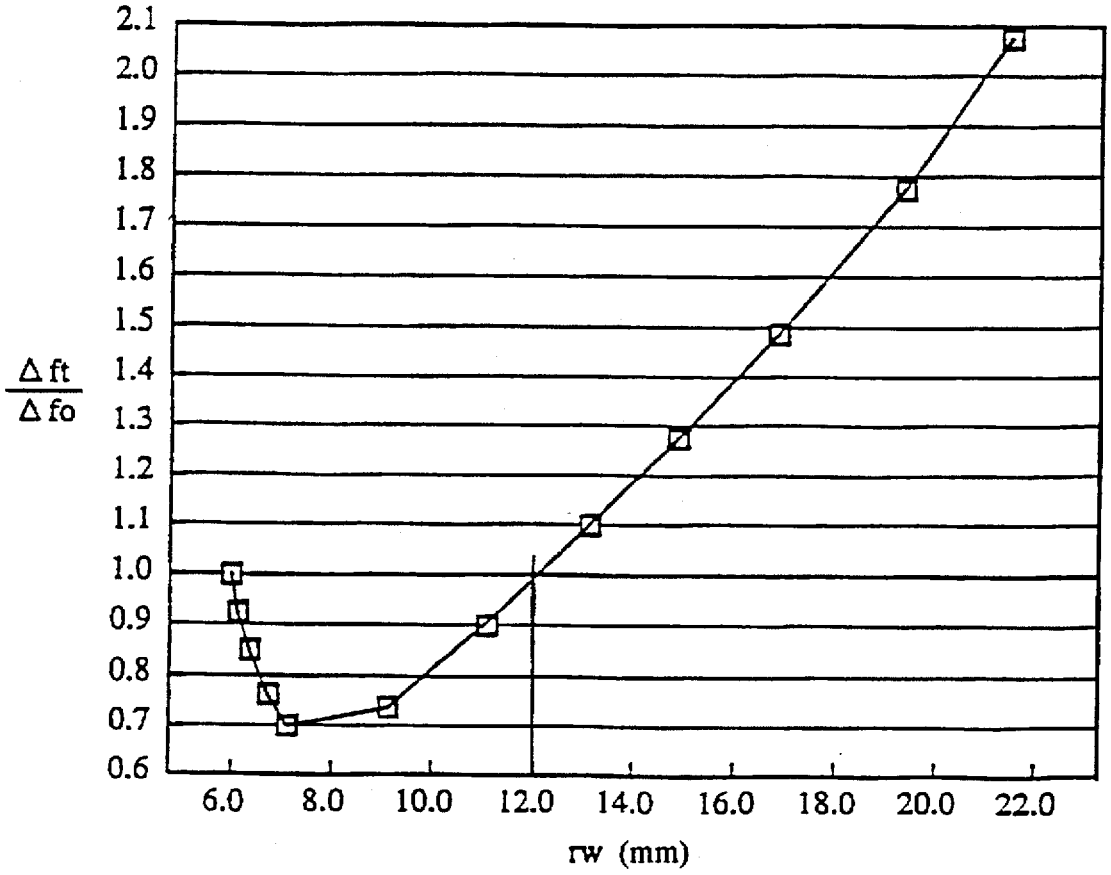
FIG. 9 is a graph showing changes in a frequency change ratio when rw specified in FIG. 8 is changed.

FIG. 8 shows the dimensions of the frequency adjusting hole and the frequency adjusting dielectric rod. The specific dielectric constant of the dielectric pillar is 37.5 and that of the frequency adjusting dielectric rod is 90.0. R indicates the radius of the arcuate end portion in mm. FIG. 9 shows the change of the magnification of the frequency change ratio when rw specified in FIG. 8 is changed, where Δft designates the frequency change ratio and Δft/Δfo designates the magnification of the frequency change ratio. Accordingly, the larger the value of Δft/Δfo, the more considerable is the effect of improvement of the frequency change by providing the void. Δfo and Δft are defined by the following equations:

$$\Delta fo=(fo'-fo)/fo,$$

$$\Delta ft=(ft'-ft)/ft$$

where fo and ft designate resonance frequencies when the frequency adjusting dielectric rod is not inserted and fo' and ft' designate resonance frequencies when the resonance frequency adjusting dielectric rod is inserted.

As illustrated in FIG. 9, an inverse effect is indicated in a range of rw=6.0–12.0 mm where the magnification Δft/Δfo of the frequency change ratio is smaller than 1.0. However, the magnification of the frequency change ratio exceeds 1.0, and there is an improvement of the frequency change ratio due to the void, in a range wherein rw exceeds 12 mm.

Figure 10:
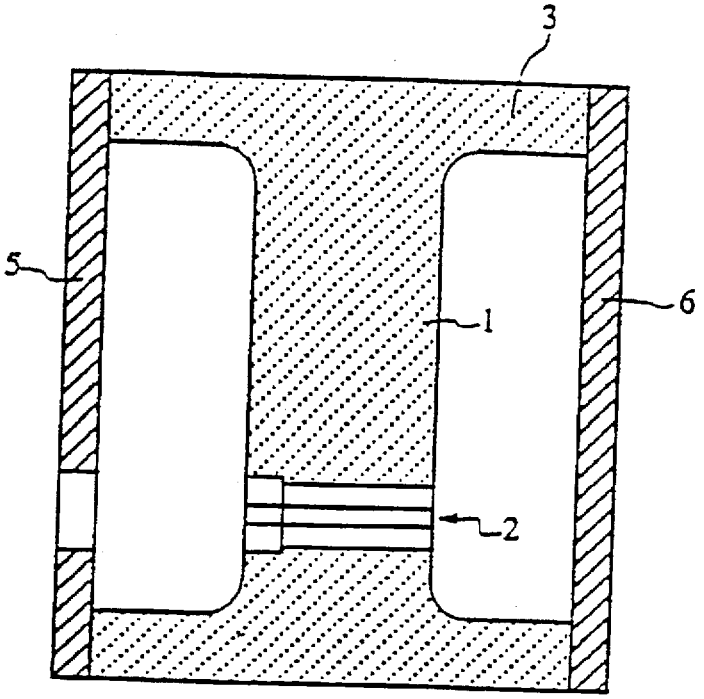
Figure 10B:
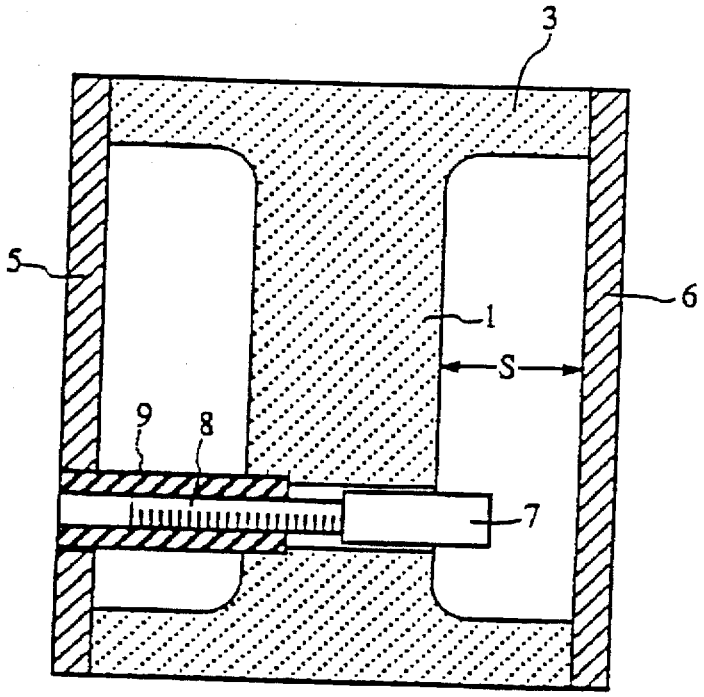

Next, FIGS. 10(A) and 10(B) show the structure of a TM mode dielectric resonator in accordance with a second embodiment. In the example of FIG. 3, a holding member 9 is installed in the metallic panel 5, and the screw member 8, to which the frequency adjusting dielectric rod 7 is attached, is threaded to the holding member. In the second embodiment, the holding member is attached to the side of the dielectric pillar. FIGS. 10(A) and 10(B) are respectively sectional views cut through a center axis of the dielectric pillar. FIG. 10(A) shows the resonator before inserting a frequency adjusting dielectric rod, a screw member, and holding member. FIG. 10(B) shows a holding member 9 attached to the side of the dielectric pillar, and a screw member 8, to which a frequency adjusting dielectric rod 7 is attached, is threaded to engage with the holding member 9.

By accommodating the screw member 8 and the holding member 9 as well as the frequency adjusting dielectric rod 7 in the resonator, the stroke of the frequency adjusting dielectric rod 7 is limited to a range shown by S in FIG. 10(B). When a small cavity is used, the stroke S is shortened. However, a sufficient frequency adjusting range can be provided since the frequency change ratio relative to the moving distance of the frequency adjusting dielectric rod is enhanced by the presence of the void.

Figure 11:
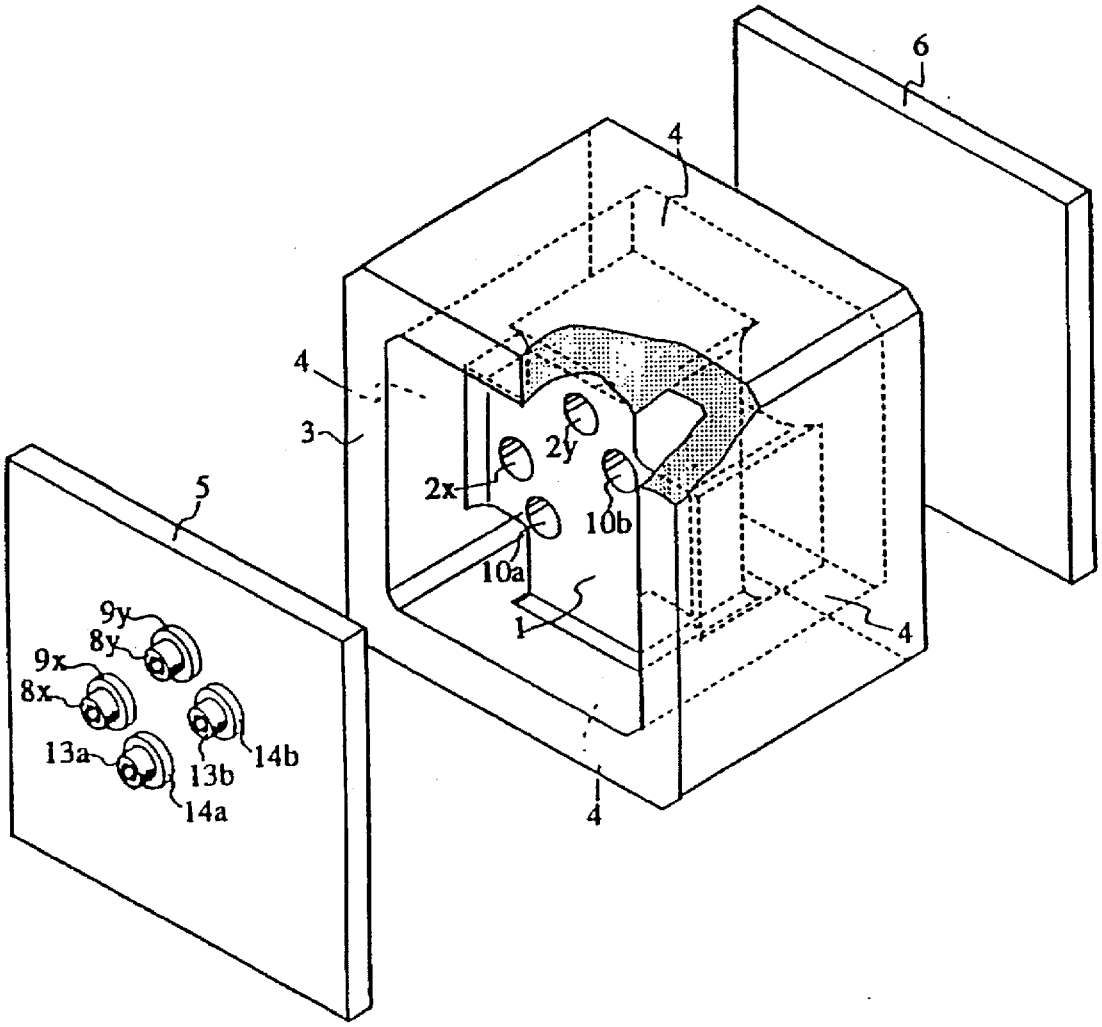
FIG. 11 is an exploded, partially broken away perspective view before assembling a TM mode dielectric resonator in accordance with a third example.

Next, FIG. 11 and FIGS. 12(A) and 12(B) show the structure of a TM mode dielectric resonator in accordance with a third embodiment.

FIG. 11 is a partially broken-away perspective view of a TM mode dielectric resonator before assembly. A dielectric pillar 1 is a composite dielectric pillar having a shape of two intersecting dielectric pillars respectively in the horizontal direction and in the vertical direction, as illustrated in FIG. 11. A frequency adjusting hole 2*x* is provided in the resonator for the horizontal dielectric pillar and a frequency adjusting hole 2*y* is provided in the resonator for the vertical dielectric pillar. Further, coupling adjusting holes 10*a* and 10*b* are formed at the intersection of the two dielectric pillars. The dielectric pillar 1 is integrally formed with the cavity 3 and a conductor 4 is formed on the outer peripheral faces of the cavity 3 as in the first embodiment. Further, a single TM mode dielectric resonator is constituted by covering two opening faces of the cavity 3 with metallic panels 5 and 6. As shown in FIG. 11, holding members 9*x* and 9*y* are respectively provided in the metallic panel 5, for holding screw members 8*x* and 8*y* to which frequency adjusting dielectric rods (not shown in FIG. 11) are attached. Holding members 14*a* and 14*b* are respectively provided in the metallic panel 5 for holding screw members 13*a* and 13*b* to which coupling adjusting dielectric rods (not shown in FIGS. 11) are attached. The frequency adjusting dielectric rods are respectively coupled with the frequency adjusting holes 2*x* and 2*y*. The coupling adjusting dielectric rods are respectively coupled with the coupling adjusting holes 10*a* and 10*b*.

FIGS. 12(A) and 12(B) are sectional diagrams cut in a direction orthogonal to the axes of the coupling adjusting holes, showing an example of a change of the dielectric flux densities in the coupling adjusting holes in the TM mode dielectric resonator shown in FIG. 11 upon insertion and withdrawal of the coupling adjusting dielectric rods. As mentioned above in reference to FIGS. 12(A) and 12(B), FIG. 12(B) schematically shows a behavior of electric lines of force in even mode and in odd mode at a sectional portion of the resonator in which the coupling adjusting dielectric rods 13*a* and 13*b* are inserted into the coupling adjusting holes 10*a* and 10*b*, whereas FIG. 12(A) schematically shows a behavior of electric lines of force in even mode and in odd mode at a sectional portion of the resonator in which the coupling adjusting dielectric rods 13*a* and 13*b* are not inserted into the coupling adjusting holes 10*a* and 10*b*. As shown in FIG. 12(A), the electric lines of force in even mode (arrow marks drawn with bold lines) detour the coupling adjusting holes 10*a* and 10*b* at the portion wherein the coupling adjusting dielectric rods are not present. As shown in FIG. 12(B), the electric lines of force in even mode pass through the coupling adjusting dielectric rods at the portion in which the coupling adjusting dielectric rods 13*a* and 13*b* are present. In this way, a difference between an effective dielectric constant with respect to the even mode and an effective dielectric constant with respect to the odd mode is considerably enhanced by inserting and withdrawing the coupling adjusting dielectric rods into and from the coupling adjusting holes, by which a wide range of coupling adjustment is obtainable by moving the coupling adjusting dielectric rods only a small distance.

Next, FIGS. 13(A) and 13(B) show the structure of a TM mode dielectric resonator in accordance with a fourth embodiment. FIGS. 13(A) and 13(B) correspond to FIGS. 12(A) and 12(B) in the third embodiment, and are similar thereto except that voids 10*a*' and 10*b*' are provided to the coupling adjusting holes 10*a* and 10*b*. FIGS. 13(A) and 13(B) show examples of a change of electric flux densities in the coupling adjusting holes of the TM mode dielectric resonator upon insertion and withdrawal of the coupling adjusting dielectric rods. As mentioned above in reference to FIGS. 13(A) and 13(B), in FIGS. 13(A) and 13(B), the coupling adjusting holes 10*a* and 10*b* are provided with the voids 10*a*' and 10*b*' orthogonal to a direction of an electric field passing through the coupling adjusting holes 10*a* and 10*b* and also orthogonal to a direction in which the coupling adjusting holes extend.

FIG. 13(B) schematically shows a behavior of electric lines of force in even mode and in odd mode at a sectional portion of the resonator in which the coupling adjusting dielectric rods 13*a* and 13*b* are inserted into the coupling adjusting holes 10*a* and 10*b*. FIG. 13(A) schematically shows a behavior of electric lines of force in even mode and in odd mode at a sectional portion of the resonator in which the coupling adjusting dielectric rods 13*a* and 13*b* are not inserted into the coupling adjusting holes 10*a* and 10*b*. As shown in FIG. 13(A), the electric lines of force in even mode (arrow marks having bold lines) detour the coupling adjusting holes 10*a* and 10*b* and the voids 10*a*' and 10*b*' at the portion in which the coupling adjusting dielectric rods 13*a* and 13*b* are not present. As shown in FIG. 13(B), the electric lines of force in even mode pass through the coupling adjusting dielectric rods at the portion in which the coupling adjusting dielectric rods 13*a* and 13*b* are present. The electric lines of force in odd mode stay constant irrespective of the presence or absence of the coupling adjusting dielectric rods. In this way, the difference between the electric flux density in the coupling adjusting holes at the portion in which the coupling adjusting dielectric rods 13*a* and 13*b* are not present, and the electric flux density in the coupling adjusting holes at the portion in which the coupling adjusting dielectric rods 13*a* and 13*b* are present, is considerably enhanced by providing the voids 10*a*' and 10*b*' orthogonal to the direction of the electric field passing through the coupling adjusting holes 10*a* and 10*b* and also orthogonal to a direction in which the coupling adjusting holes extend. Thereby, the ratio of the change of coupling coefficient relative to the distance of insertion and withdrawal of the coupling adjusting dielectric rods is enhanced, more than that enhancement in the third embodiment.

According to the TM mode dielectric resonator in accordance with the first and the second aspects of the present invention, the electric flux density in the frequency adjusting hole is considerably changed depending on the presence or absence of the frequency adjusting dielectric rod, and the frequency change ratio relative to the amount of movement of the frequency adjusting dielectric rods is enhanced. Accordingly, a wide range of frequency adjustment can be provided even in a downsized TM mode dielectric resonator without especially magnifying the frequency adjusting dielectric rod.

Especially, according to the TM mode dielectric resonator in accordance with the second aspect of the present invention, the electric lines of force which have detoured the frequency adjusting hole and the void at a portion thereof in which the frequency adjusting dielectric rod is not inserted into the frequency adjusting hole, now cross the frequency adjusting dielectric rod when the frequency adjusting dielectric rod is inserted into the frequency adjusting hole. Therefore, the frequency change ratio relative to the amount of movement of the frequency adjusting dielectric rod can firmly be enhanced.

According to the TM mode dielectric resonator in accordance with the third and the fourth aspect of the present invention, the difference between the effective dielectric constant with respect to the even mode and the effective dielectric constant with respect to the odd mode is considerably changed by inserting and drawing the coupling adjusting dielectric rods into and from the coupling adjusting holes, and a wide range of coupling adjustment is made possible by a small amount of movement of the coupling adjusting dielectric rods. Therefore, a wide range of coupling adjustment can be achieved even in a downsized TM mode dielectric resonator.

Especially, according to the TM dielectric resonator in accordance with the fourth aspect of the present invention, a wide range of coupling adjustment is made possible by an even smaller amount of movement of the coupling adjusting dielectric rods.

Although embodiments of the invention have been disclosed herein, the invention is not limited to those examples, but rather the fair spirit and scope of the invention should be considered to include modifications and variations thereof that may occur to a person having the ordinary level of skill in the art.

What is claimed is:

1. A TM mode dielectric resonator comprising:

a dielectric pillar disposed in a space surrounded by a conductor for guiding an electric field in a resonance condition;

a frequency adjusting hole formed in the dielectric pillar extending in a direction substantially orthogonal to a direction of said electric field in said resonance condition;

a void extending from the frequency adjusting hole in a direction substantially orthogonal to the direction of the electric field and also orthogonal to a direction in which the frequency adjusting hole extends;

a frequency adjusting dielectric rod guidable only in the frequency adjusting hole for an inserting and withdrawing movement therein; and wherein, in said resonance condition, the void blocks a first electric flux at a first portion in the frequency adjusting hole into which the frequency adjusting dielectric rod is not inserted, and concentrates a second electric flux at a second portion in the frequency adjusting hole into which the frequency adjusting dielectric rod is inserted, thereby enhancing a difference between a first electric flux density at said first portion in the frequency adjusting hole and a second electric flux density at said second portion in the frequency adjusting hole.

2. The TM mode dielectric resonator according to claim 1, wherein the void has a width dimension extending in a direction away from the frequency adjusting hole, the width dimension being smaller than a width of the frequency adjusting dielectric rod.

3. The TM mode dielectric resonator according to claim 1, wherein said void is polygonal in cross-section and said frequency adjusting hole is circular in cross-section in a plane substantially in the direction of said electric field in said resonance condition.

4. The TM mode dielectric resonator according to claim 3, wherein said frequency adjusting dielectric rod is circular in cross-section in said plane.

5. The TM mode dielectric resonator according to claim 1, wherein said void being a first void, and said resonator comprising a second void at an opposite side of said frequency adjusting hole from said first void, said frequency adjusting hole and said first and second voids together are of an elliptical cross-section in a plane substantially in the direction of said electric field in said resonance condition.

6. The TM mode dielectric resonator according to claim 5, wherein said frequency adjusting dielectric rod is circular in cross-section in said plane.

7. The TM mode dielectric resonator according to claim 1, wherein said void being a first void, and said resonator having a second void at an opposite side of said frequency adjusting hole from said first void, each said first and second void being in a plane substantially in the direction of said electric field in said resonance condition and having ends defined by a radius, said radius being smaller than a radius defining said frequency adjusting hole.

8. The TM mode dielectric resonator according to claim 7, wherein said frequency adjusting dielectric rod is circular in cross-section in said plane.

9. The TM mode dielectric resonator according to claim 1, wherein said void is a first void, and said resonator having a second void at an opposite side of said frequency adjusting hole from said first void, each said first and second void and said frequency adjusting hole being polygonal in cross-section in a plane substantially in the direction of said electric field in said resonance condition.

10. The TM mode dielectric resonator according to claim 9, wherein said frequency adjusting dielectric rod is polygonal in cross-section in said plane.

* * * * *